US009685294B2

(12) United States Patent
Nomura et al.

(10) Patent No.: US 9,685,294 B2
(45) Date of Patent: Jun. 20, 2017

(54) FUSE

(71) Applicant: YAZAKI CORPORATION, Tokyo (JP)

(72) Inventors: Syouichi Nomura, Aichi (JP); Gorou Nakamura, Aichi (JP); Eiji Shimochi, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 261 days.

(21) Appl. No.: 14/053,814

(22) Filed: Oct. 15, 2013

(65) Prior Publication Data

US 2014/0035717 A1 Feb. 6, 2014

Related U.S. Application Data

(63) Continuation of application No. PCT/JP2012/060636, filed on Apr. 19, 2012.

(30) Foreign Application Priority Data

Apr. 22, 2011 (JP) ..... 2011-095957

(51) Int. Cl.
*H01H 85/02* (2006.01)
*H01H 85/11* (2006.01)
(Continued)

(52) U.S. Cl.
CPC ..... *H01H 85/02* (2013.01); *H01H 85/0456* (2013.01); *H01H 85/11* (2013.01);
(Continued)

(58) Field of Classification Search
CPC .... H01H 85/153; H01H 85/11; H01H 85/165; H01H 85/02; H01H 85/0456; H01H 85/204; H01H 85/175
(Continued)

(56) References Cited

U.S. PATENT DOCUMENTS 4,511,875 A * 4/1985 Arikawa ..... H01H 85/0411 337/186
4,570,147 A * 2/1986 Ebi ..... H01H 85/0417 337/166
(Continued)

FOREIGN PATENT DOCUMENTS

CN 101578679 A 11/2009
JP 5-2360 U 1/1993
(Continued)

OTHER PUBLICATIONS

Japanese Office Action for the related Japanese Patent Application No. 2011-095957 dated Dec. 2, 2014.
(Continued)

*Primary Examiner* — Anatoly Vortman
(74) *Attorney, Agent, or Firm* — Kenealy Vaidya LLP

(57) ABSTRACT

A fusible link (11) includes a fuse element (13) provided with a fusible conductor part (25) which has a melting part (31) provided between parallel inner side edges (21) of a first terminal part (17) and a second planar terminal part (19). The fusible link (11) also includes an insulative housing (15), having a melting part accommodating space (35) to accommodate the melting part (31) therein, which is mounted to a front surface side of the fuse element (13) to cover the inner side edges (21) of the first planar terminal part (17) and the second planar terminal part (19) and the fusible conductor part (25).

8 Claims, 9 Drawing Sheets

(51) Int. Cl.

| | |
|---|---|
| ***H01H 85/153*** | (2006.01) |
| ***H01H 85/045*** | (2006.01) |
| ***H01H 85/165*** | (2006.01) |
| *H01H 85/175* | (2006.01) |
| *H01H 85/20* | (2006.01) |

(52) U.S. Cl.
CPC ..... *H01H 85/153* (2013.01); *H01H 85/165* (2013.01); *H01H 85/175* (2013.01); *H01H 85/204* (2013.01)

(58) Field of Classification Search
USPC ..... 337/228, 159, 180, 181, 186, 187, 251
See application file for complete search history.

(56) References Cited

U.S. PATENT DOCUMENTS 4,608,548 A * 8/1986 Borzoni ..... H01H 85/0417 337/186
4,635,023 A * 1/1987 Oh ..... H01H 85/055 337/163
4,894,633 A * 1/1990 Holtfreter ..... H01H 85/0411 337/201
5,101,187 A * 3/1992 Yuza ..... H01H 85/0417 337/255
5,227,759 A 7/1993 Hatagishi
5,229,739 A 7/1993 Oh et al.
5,293,147 A * 3/1994 Oh ..... H01H 69/02 337/201
5,398,015 A * 3/1995 Kudo ..... H01H 85/0417 337/255
5,606,301 A * 2/1997 Ishimura ..... H01H 85/0411 29/623
5,668,521 A * 9/1997 Oh ..... H01C 1/1406 337/186
5,668,522 A * 9/1997 Kondo ..... H01H 85/0417 337/160
5,726,620 A * 3/1998 Arikawa ..... H01H 85/157 337/186
5,854,583 A * 12/1998 Falchetti ..... H01H 85/044 337/159
5,977,859 A 11/1999 Kawamura et al.
6,067,004 A * 5/2000 Hibayashi ..... H01H 85/044 337/186
6,275,135 B1 8/2001 Hibayashi et al.
6,294,978 B1 * 9/2001 Endo ..... H01H 85/044 337/159
6,448,882 B1 * 9/2002 Inaba ..... H01H 85/044 337/159
6,486,766 B1 * 11/2002 Reid ..... H01H 85/201 337/180
6,577,222 B1 * 6/2003 Krueger ..... H01H 85/17 337/180
6,642,834 B1 * 11/2003 Oh ..... H01H 85/0417 337/273
7,612,646 B2 * 11/2009 Kubota ..... H01H 85/2035 337/186
7,637,781 B2 12/2009 Matsumoto et al.
8,203,420 B2 * 6/2012 Wiryana ..... H01H 85/175 337/232
8,587,401 B2 * 11/2013 Tong ..... H01H 85/044 337/157
8,629,749 B2 * 1/2014 Chiu ..... H01H 85/165 337/159
2001/0048579 A1 12/2001 Kanamaru et al.
2002/0008608 A1 1/2002 Brown et al.
2002/0036880 A1 3/2002 Kanamaru et al.
2009/0111316 A1 4/2009 Matsumoto et al.
2009/0189730 A1 7/2009 Oh et al.
2010/0194519 A1 * 8/2010 Harris ..... H01H 85/045 337/227
2010/0245025 A1 * 9/2010 de Leon ..... H01H 85/0418 337/290
2010/0328020 A1 * 12/2010 Wiryana ..... H01H 85/175 337/232
2011/0095859 A1 4/2011 Shibata

FOREIGN PATENT DOCUMENTS

JP 2637846 B2 4/1997
JP 10-199396 A 7/1998
JP 10-283906 A 10/1998
JP 2000-113803 A 4/2000
JP 2000-195408 A 7/2000
JP 2001-273848 A 10/2001
JP 2001-351502 A 12/2001
JP 3630364 B2 3/2005
JP 4096431 B2 6/2008
JP 2009-110807 A 5/2009
JP 2010-108787 A 5/2010
JP 2010-161017 A 7/2010
JP 2010-287443 A 12/2010

OTHER PUBLICATIONS

Japanese Office Notification for the related Japanese Patent Application No. 2011-095957 dated Jun. 24, 2014.
International Search Report and Written Opinion of the International Search Report for PCT/JP2012/060636 dated Jul. 10, 2012.
The extended European search report for the related European Patent Application No. 12774483.7 dated Sep. 25, 2014.
Chinese Office Action and Search Report for the related Chinese Patent Application No. 201280019530.X dated Feb. 13, 2015.
English language Written Opinion of the International Search Report for PCT/JP2012/060636 dated Jul. 10, 2012.
Japanese Office Action for the related Japanese Patent Application No. 2011-095957 dated Feb. 10, 2015.
European Office Action for the related European Patent Application No. 12 774 483.7 dated Nov. 29, 2016.

* cited by examiner (a)

(b)

FUSE

CROSS REFERENCE TO RELATED APPLICATIONS

This application is a continuation of PCT application No. PCT/JP2012/060636, which was filed on Apr. 19, 2012 based on Japanese Patent Application (No. 2011-095957) filed on Apr. 22, 2011, the contents of which are incorporated herein by reference.

BACKGROUND OF THE INVENTION

1. Field of the Invention

The present invention relates to a fuse which is suitably used in, for example, a power supply box of a vehicle or the like.

2. Description of the Related Art

Traditionally, a cartridge fusible link 501 as shown in FIG. 9 is known. The cartridge fusible link 501 is so provided that a generally U-shaped fuse element 503 which is formed by forging a metal plate is accommodated in a box-shaped case body 505 and a transparent cover 507 is overlaid on the case body 505. The fuse element 503 is provided with a generally belt-shaped fusible conductor part 509 which has a melting part 511 on which a low melting point metal chip is mounted and a pair of terminal parts 513 which are provided at two ends of the fusible conductor part 509. The fusible conductor part 509 and the pair of terminal parts 513 are integrally formed by a metal plate. A fuse circuit is formed in a power supply box 515 when the cartridge fusible link 501 is mounted onto the power supply box 515 as shown in FIG. 10 (refer to JP-A-2010-108787).

The power supply box 515 includes a blade fuse area 520 (an area enclosed by one-dot-chain lines in FIG. 10) which is divided vertically and horizontally into blade fuse cavities 519 to accommodate a number of blade fuses 517, respectively, and a fusible link area 530 (an area enclosed by dashed lines in FIG. 10) which is divided into cartridge fusible link cavities 521 to accommodate the cartridge fusible links 501. There are other cavities on which electrical components are mounted such as relays, electronic units in the power supply box 515, but these cavities are not related to the present invention and the explanations are omitted.

The blade fuses 517 are mounted in the blade fuse cavities 519, respectively, and the cartridge fusible links 501 are mounted in the cartridge fusible link cavities 521, respectively.

SUMMARY OF THE INVENTION

However, because the traditional cartridge fusible link 501, as shown in FIG. 9, is formed by assembling three components, which are the fuse element 503, the case body 505 and the transparent cover 507, such many components increases the component cost. For the cartridge fusible link 501, there is also a problem that the product size will be increased depending on the rated current capacity. Therefore, as the number of fuse circuits is increased by adding the electric components, the number of the cartridge fusible links 501 is increased accordingly so that the size (shape) of the power supply box 515 becomes upsized and the weight (mass) may be increased.

A known type of fusible link is a chain fusible link which integrally includes a plurality of fuse circuits. But, the chain fusible link and the cartridge fusible link 501 are exclusive components, respectively. Therefore, to accommodate the two types of fusible links in the power supply box 515, exclusive spaces for the two types of fusible links are necessary. As a result, there is a problem in this case that the power supply box 515 is upsized.

The present invention is made in view of the above situations, and an object of the present invention is to provide a fuse for which the number of components can be decreased, the space of the power supply box can be saved, and the fuse may be commonly used in a chain fusible link.

The above object of the present invention is achieved by the following configurations (1) to (4).

(1) A fuse including: a fuse element which includes a first planar terminal part, a second planar terminal part, and a melting part, wherein the melting part is provided between parallel inner side edges of the first planar terminal part and the second planar terminal part and has a low melting point metal chip; and an insulative housing, having a melting part accommodating space to accommodate the melting part therein, which is mounted to a front surface side of the fuse element to cover the inner side edges of the first planar terminal part and the second planar terminal part and the melting part.

According to the fuse of the above configuration (1), the fuse element, which is provided with the melting part, on which the low melting point metal chip is mounted, between the first planar terminal part and the second planar terminal part which are arranged in the same plane, is formed to be generally planar-shaped. The front surface side of the fuse element is covered with the insulative housing in which the melting part accommodating space is formed to accommodate the melting part.

That is, the fuse is flat as a whole while the site where the insulative housing covers the melting part is thickened partially. Thus, a plurality of fuses can be overlapped in parallel in the plate thickness direction of the fuse element, or a plurality of fuses can be arranged side by side to fuse circuits in the same plane.

Therefore, since the fuse is provided with two components, which are, the fuse element and the insulative housing, and since the freedom in layout increases due to the flat shape, the component number may be decreased, the space of the power supply box can be saved, and the fuse may be commonly used in a chain fusible link.

(2) The fuse according to the above configuration (1), wherein welding bosses which are protruded from a mounting surface of the insulative housing are welded in engaging recesses which are formed at upper and lower edges of the first planar terminal part and the second planar terminal part.

According to the fuse of the above configuration (2), the welding bosses, which are provided integrally with and protruded from the insulative housing that covers the melting part, are inserted into the engaging recesses which are formed respectively at the upper and lower edges of the first planar terminal part and the second planar terminal part, and insertion distal ends of the welding bosses are welded at the insertion back surface sides of the engaging recesses. Thereby, the operation of mounting the insulative housing to the fuse element becomes easy and the productivity is improved without increasing the number of components.

The fuse according to the configuration (1) or (2), wherein a rated current capacity of the fuse is variable by changing at least one of a conductivity of the fuse element and a width of a fusible conductor part which has the melting part.

According to the fuse of the above configuration (3), it is possible to change to an appropriate fuse performance (rated current capacity) to match different specifications for the fuse while the same external shape is maintained.

The fuse according to any one of the configurations (1) to (3), wherein the first planar terminal part is electrically connected by being connected to a connecting plate which is electrically connected to a battery terminal, and the second planar terminal part is electrically connected by being connected to a terminal part which is electrically connected to an output side electric circuit.

According to the fuse of the above configuration (4), since the connecting plate and the terminal part are electrically connected by the fuse, the chain fuse, which integrally includes a plurality of fuse circuits between a battery terminal and output side electric circuits, can be easily constructed.

The present invention has been briefly described above. Details of the invention will become more apparent after embodiments of the invention described below (hereinafter referred to as "embodiments") are read with reference to the accompanying figures.

DETAILED DESCRIPTION OF THE EXEMPLARY EMBODIMENTS

A fuse according to one embodiment of the present invention is described in detail as follows with reference to the attached drawings.

Figure 1:
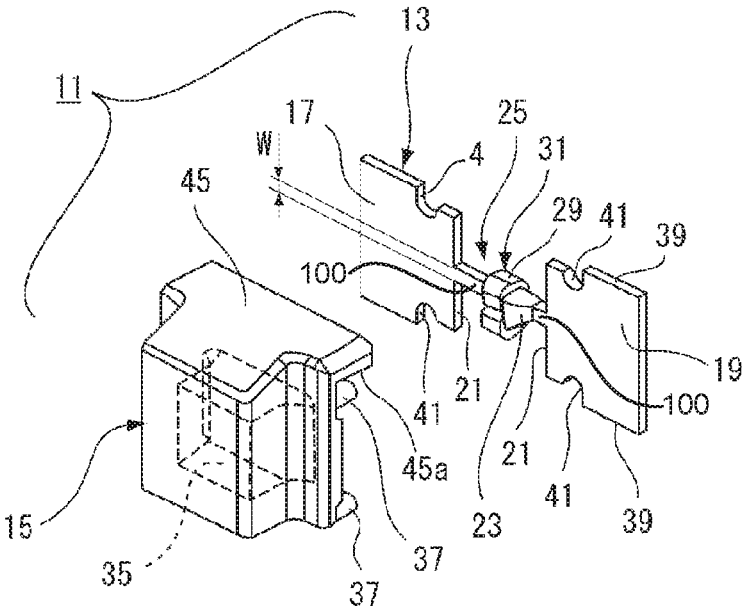
FIG. 1 is an exploded perspective view of a fuse according to one embodiment of the present invention.
Figure 2:
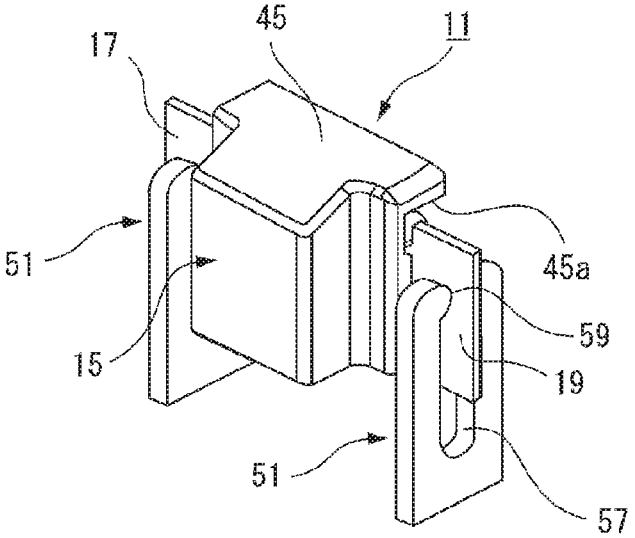
FIG. 2 is a perspective view which shows that the fuse shown in FIG. 1 is mounted to mating terminals.
Figure 3:
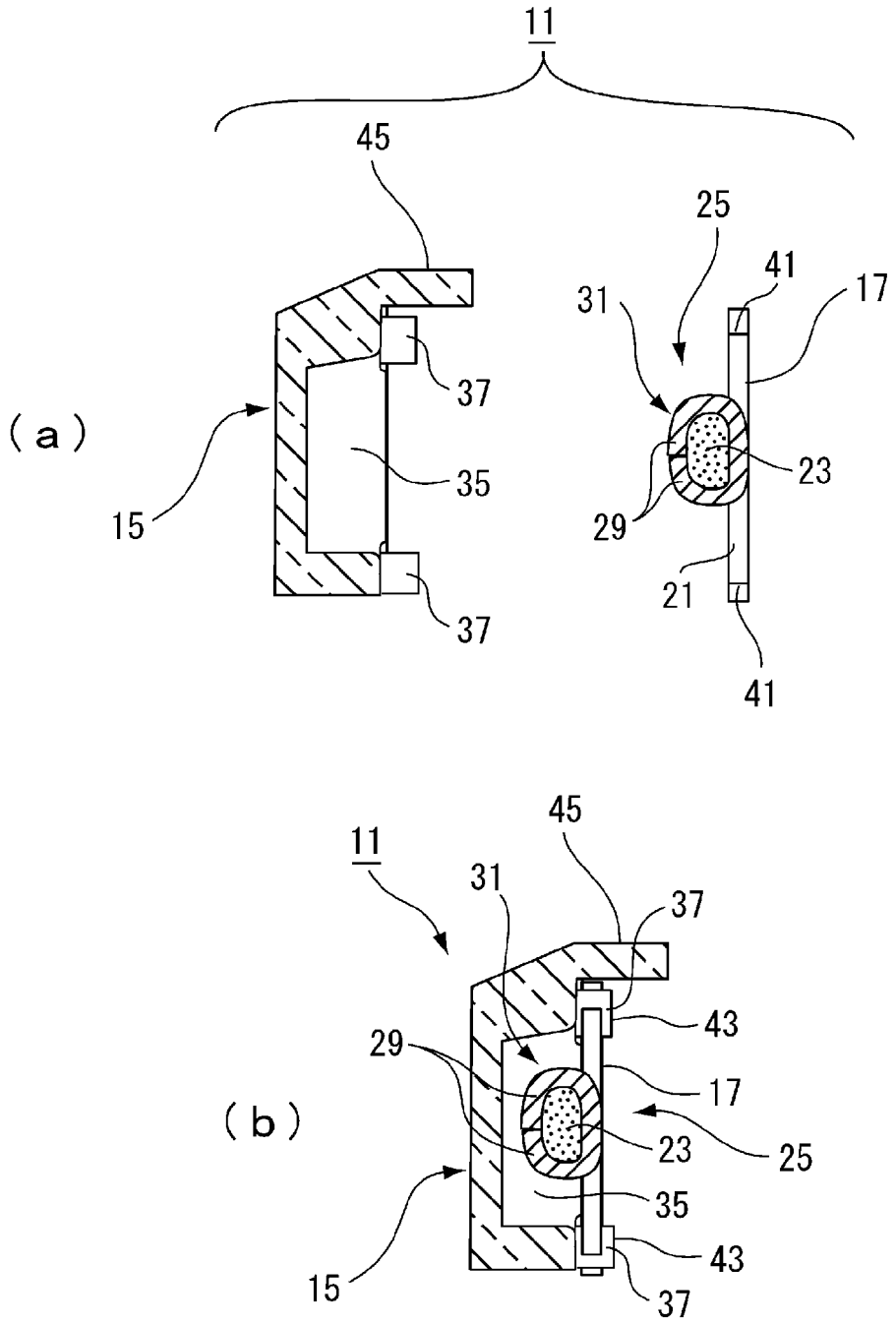
In FIG. 3, (*a*) is a longitudinal sectional view in which the fuse shown in FIG. 1 is cut at a melting part, and (*b*) is a longitudinal sectional view which shows the fuse shown in FIG. 2 is cut at the melting part.

A fusible link 11 according to a first embodiment of the present invention, as shown in FIGS. 1 to 3(*b*), is a fuse which mainly includes a fuse element 13 and an insulative housing 15.

The fuse element 13 is provided with a generally belt-shaped fusible conductor part 25 between parallel inner side edges 21 of a first planar terminal part 17 and a second planar terminal part 19. The belt-shaped fusible conductor part 25 has a melting part 31, on which a low melting point metal chip 23 is mounted. In the fuse element 13, the first planar terminal part 17 and the second planar terminal part 19 are connected to an electric circuit, and the generally belt-shaped fusible conductor part 25 is electrically connected to the first planar terminal part 17 and the second planar terminal part 19. The first planar terminal part 17 and the second planar terminal part 19 are integrally formed by press-molding a metal plate such as a copper (Cu) plate or an aluminum (Al) plate which serves as a base material.

The width of the fusible conductor part 25 may be narrowed to be more easily melted based on predetermined melting performance. That is, the rated current capacity of the fusible link 11 can be changed or variable by changing at least one of the conductivity of the fuse element 13 and a width W of the fusible conductor part 25 which has the melting part 31. Thereby, it is possible to change to an appropriate fuse performance (rated current capacity) to match different specifications for the fusible link 11 while the same external shape is maintained. That is, it is not necessary to upsize the fusible link 11 to match the rated current capacity.

As shown in FIGS. 1, 3(*a*) and 3(*b*), the fusible conductor part 25 is formed with the melting part 31 which includes a pair of crimping pieces 29. The crimping pieces 29 extend in the widthwise direction of the fusible conductor part 25, respectively, and by being crimped by the crimping pieces 29, the low melting point metal chip 23 whose melting point is lower than the fuse element 13 is crimped and fixed to the melting part 31. The low melting point metal chip 23 is made of low melting point metal such as tin (Sn) or tin alloy whose melting point is lower than copper which is the base material of the first planar terminal part 17, the second planar terminal part 19 and the fusible conductor part 25.

Thus, the fuse element 13 according to the present embodiment is formed into a so-called time delay fuse which, when an overcurrent passes through the fusible conductor part 25, ensures a time delay before the fusible conductor part 25 melts because the heat generated in the melting part 31 is transmitted to and absorbed by the low melting point metal chip 23.

That is, for a load circuit such as an electric motor, when the electric motor is started, a momentary overcurrent whose value is several times of a steady load current value flows, and for a power window motor, at the time of motor locking when the window glass is shut or opened, a motor locking current whose value is several times of a steady load current value flows. Then, an electric current which exceeds the steady current value frequently flows even if there is no abnormality such as a circuit short. Thus, when the above-described fuse element 13 is used, the momentary overcurrent or the motor locking current whose value exceeds a steady current value will not cause the fuse to melt, but when a slight short happens, the fuse will melt quickly so that an overcurrent can be surely cut off.

The insulative housing 15 according to the present embodiment is integrally molded by synthetic resin material. A melting part accommodating space 35, as shown in FIGS. 3(*a*) and 3(*b*), is formed in the insulative housing 15 to accommodate the melting part 31. The insulative housing 15 is mounted to the front surface side of the fuse element 13 to cover the inner side edges 21 of the first planar terminal part 17 and the second planar terminal part 19 and the melting part 31.

Four welding bosses 37 are protruded from the mounting surface of the insulative housing 15. The welding bosses 37 are inserted into engaging recesses 41 which are formed respectively at the upper and lower edges 39 of the first planar terminal part 17 and the second planar terminal part 19, and insertion distal ends 43 of the welding bosses 37 are welded at the insertion back surface sides of the engaging recesses 41. Thereby, the operation of installing the insulative housing 15 to the fuse element 13 becomes easy and the productivity is improved without increasing the number of components. Since the insulative housing 15 surely covers the melting part 31 of the fuse element 13, the melting fragments are prevented from flying to damage other fusible links 11 or the like.

A top surface cover part 45 which is approximately T-shaped when viewed from top is formed at the top surface of the insulative housing 15. The top surface cover part 45 covers a part (near the engaging recesses 41) at the upper parts of the first planar terminal part 17 and the second planar terminal part 19. The top surface cover part 45 prevents the melting fragments from flying upwards, and, when the fusible link 11 which is mounted in a fusible link cavity 55 of a power supply box 47 to be described below is pulled out, two ends 45*a* of the top surface cover part 45 become engaging parts which are engaged with a pulling-out tool.

As shown in FIG. 2, the fusible link 11 according to the first embodiment is mounted to mating terminals 51 which are provided with, for example, U-shaped terminal insertion cuts 57.

The mating terminal 51 has such a shape that the U-shaped terminal insertion cut 57 is formed, and contacting salients 59 which make the opening narrower are formed at the entrance of the terminal insertion cut 57.

When the first planar terminal part 17 and the second planar terminal part 19 are respectively inserted into the terminal insertion cuts 57 of a pair of mating terminals 51, the front surfaces and the back surfaces contact the contacting salients 59. Thereby, the pair of mating terminals 51 is connected electrically.

Figure 4:
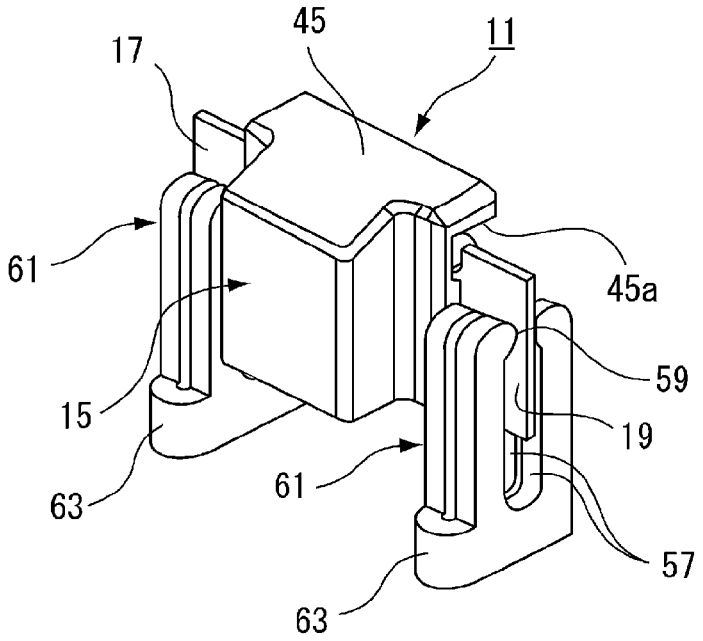
FIG. 4 is a perspective view which shows the fuse shown in FIG. 1 is mounted to double mating terminals.

As shown in FIG. 4, the fusible link 11 can be mounted to double mating terminals 61.

The double mating terminal 61 is a mating terminal which includes a pair of parallel terminal insertion cuts 57 and is formed by punching a metal plate into two parts of the same shape as the above mating terminal 51 which are joined together by a joining part 63 and bending the metal plate at the joining part 63 by 180 degrees so that the two parts are overlapped.

In this way, since the first planar terminal part 17 and the second planar terminal part 19 of the fusible link 11 are respectively connected to the pair of double mating terminals 61, four places can contact the contacting salients 59 at one side, and stable electrical connection can be realized and high connecting reliability can be achieved.

Figure 5:
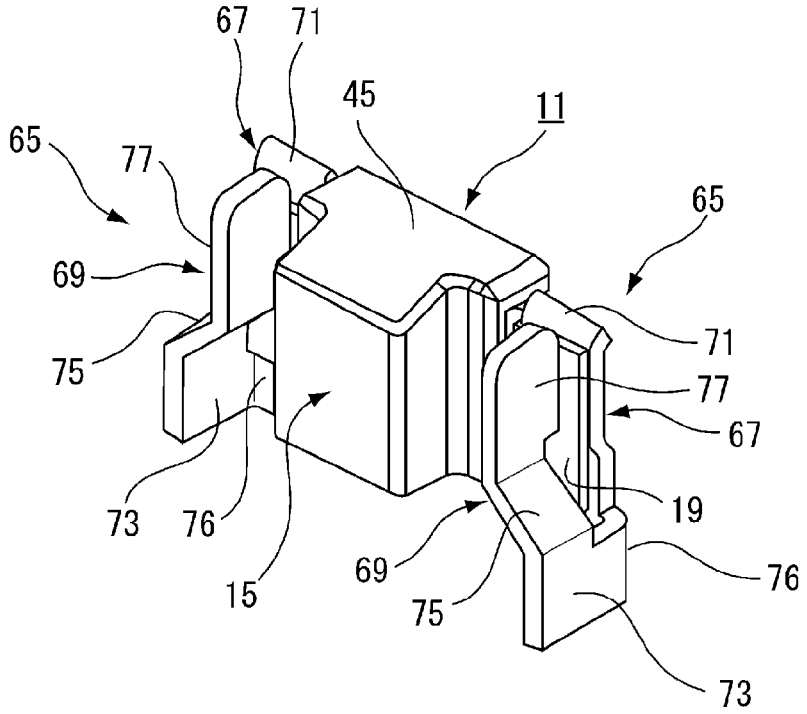
FIG. 5 is a perspective view which shows the fuse shown in FIG. 1 is mounted to bended mating terminals.

Furthermore, as shown in FIG. 5, the fusible link 11 also can be mounted to bended mating terminals 65.

The bended mating terminal 65 includes a terminal piece 67, which is parallel to the first planar terminal part 17 and the second planar terminal part 19, at one side, and a perpendicular terminal piece 69, which is formed by being bended to be perpendicular to the terminal piece 67, at the other side.

That is, the perpendicular terminal piece 69 includes a terminal base part 73 which is bended by 90 degrees relative to a terminal base part 76 of the terminal piece 67, an inclined part 75 which is formed above the terminal base part 73, and a contacting piece 77 which is arranged at the middle of the terminal piece 67 in the widthwise direction. A receiving surface 71 is formed at the top surface of the terminal piece 67 to guide the insertion of the first planar terminal part 17 and the second planar terminal part 19.

Figure 6:
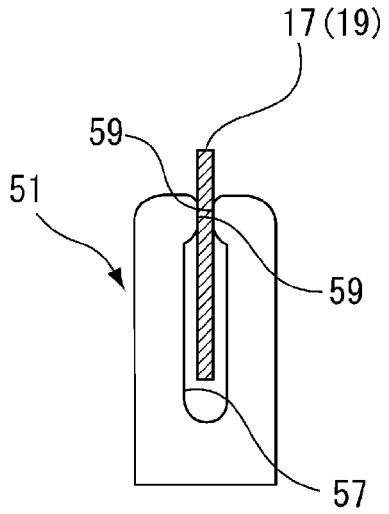
In FIG. 6, (*a*) is a longitudinal sectional view which shows that the fuse contacts the mating terminals to which the fuse is mounted as shown in FIG. 2, and (*b*) is a longitudinal sectional view which shows that the fuse contacts the double mating terminals to which the fuse is mounted as shown in FIG. 5.
Figure 6:
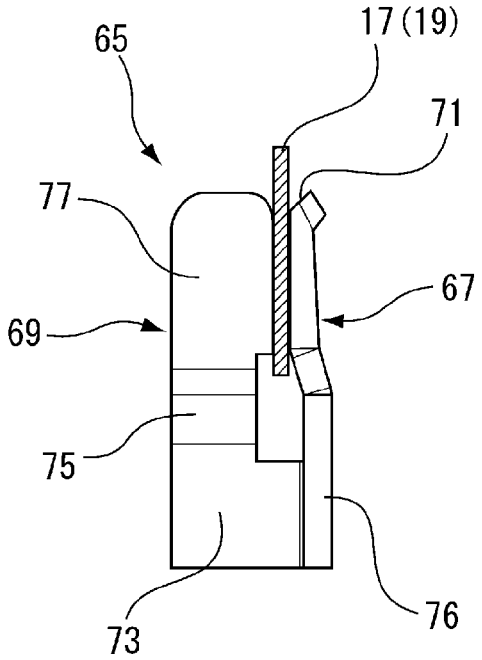

The first planar terminal part 17 and the second planar terminal part 19 of the fusible link 11 are connected by a pair of the bended mating terminals 65, respectively, compared to the case where the first planar terminal part 17 and the second planar terminal part 19 are connected by the mating terminals 51 as shown in FIG. 6(*a*). In this way, when the first planar terminal part 17 and the second planar terminal part 19 are connected by the bended mating terminals 65, as shown in FIG. 6(*b*), the areas in which the first planar terminal part 17 or the second planar terminal part 19 contacts the bended mating terminals 65 can be significantly increased, and the electrical connection of the fusible link 11 of a large rated current capacity type is realized.

Then, the operations of the fusible link 11 which has the above-described structure are described.

As described above, in the fusible link 11 according to the present embodiment, the fuse element 13, which is provided with the melting part 31 on which the low melting point metal chip 23 is mounted between the first planar terminal part 17 and the second planar terminal part 19 which are arranged in the same plane, is formed to be generally planar-shaped. The front surface side of the fuse element 13 is covered with the insulative housing 15 in which the melting part accommodating space 35 is formed to accommodate the melting part 31.

Figure 11:
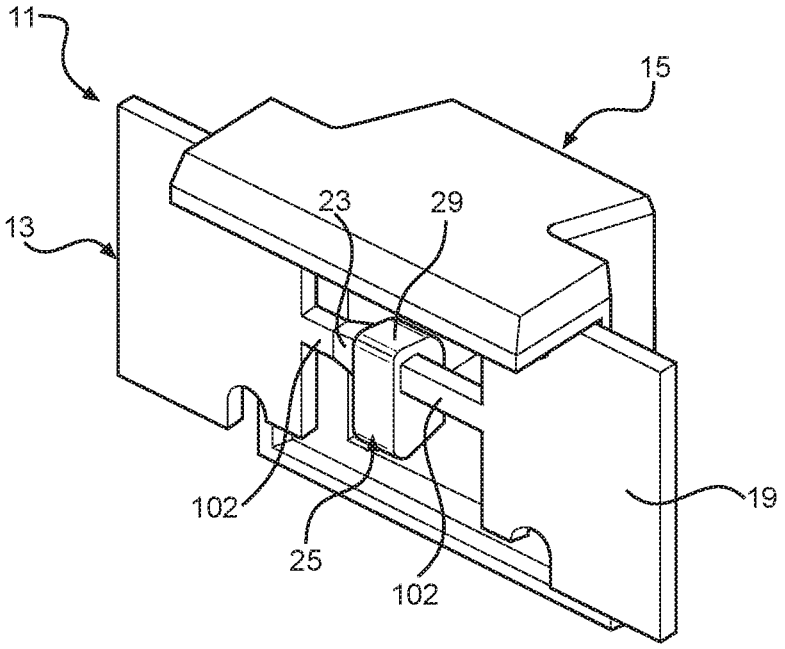
FIG. 11 is a perspective view of the rear side of the fuse of FIG. 1.

Referring to FIG. 1, the front surface side can include a front portion 100 bounding either side of the melting part 31 that is covered by the insulative housing 15. In contrast, the rear surface side can include a rear portion 102 that directly opposes the front portion 100. As shown in FIG. 11, the rear portion 102 of the rear surface side lies outside of the insulative housing 15.

That is, the fusible link 11 is flat as a whole while the site where the insulative housing 15 covers the melting part 31 is thickened partially. Thus, a plurality of fusible links 11 can be overlapped in parallel in the plate thickness direction of the fuse element 13, or a plurality of fusible links 11 can be arranged side by side to fuse circuits in the same plane.

Figure 7:
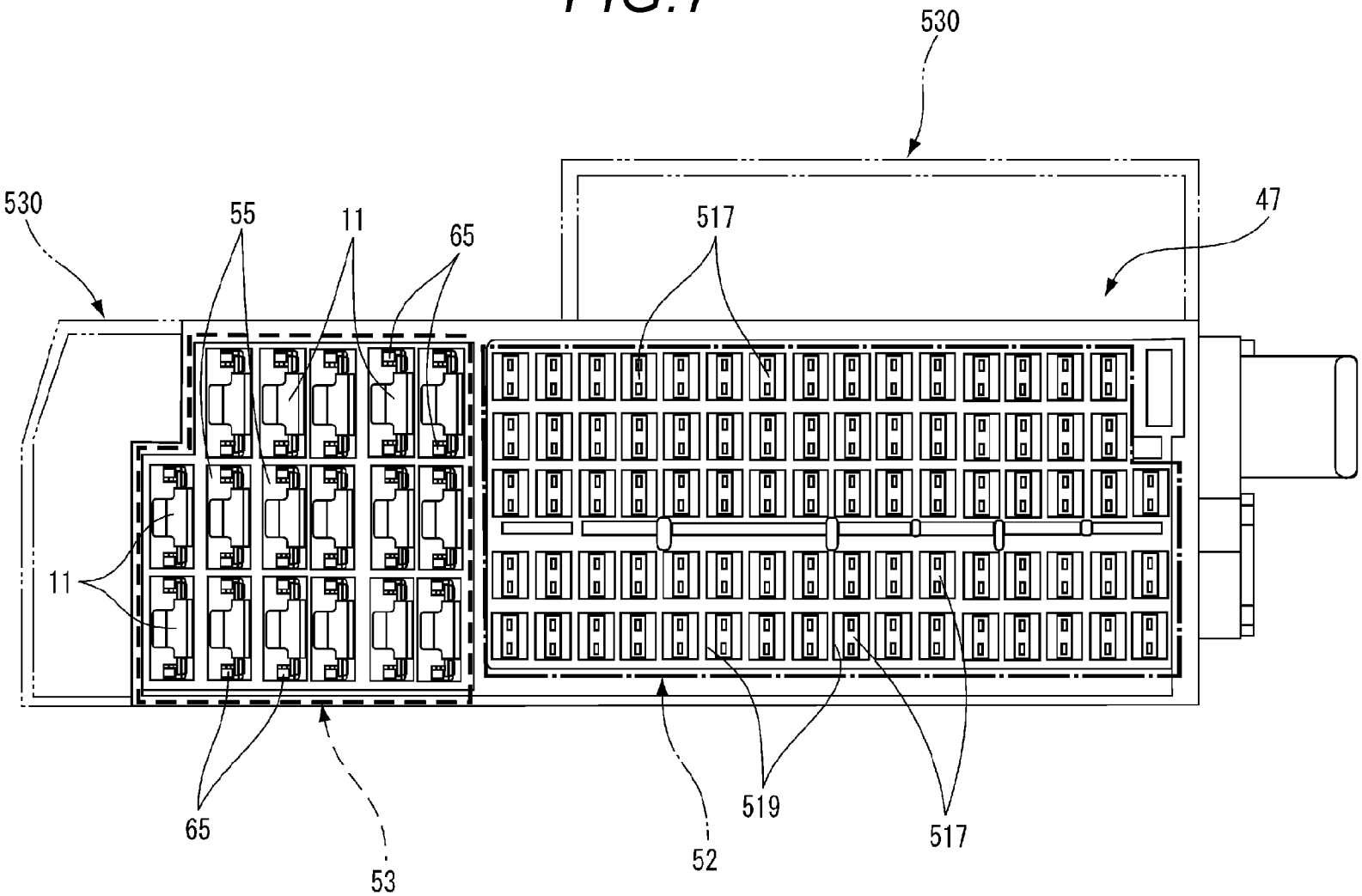
FIG. 7 is a planar view of the power supply box on which the fuse is mounted shown in FIG. 1.
Figure 8:
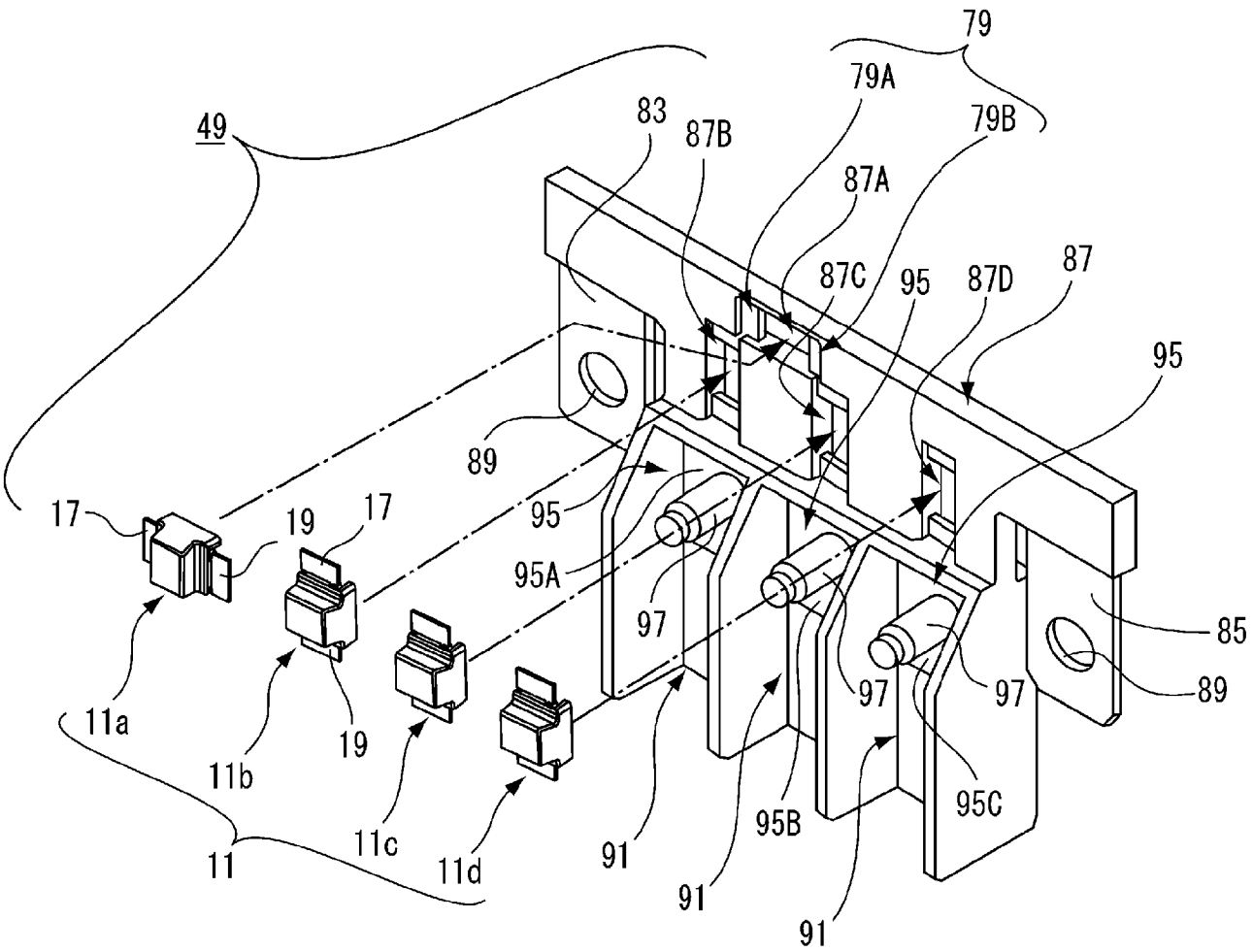
FIG. 8 is a perspective view of main parts of a chain fuse in which the fuse shown in FIG. 1 is used.
Figure 9:
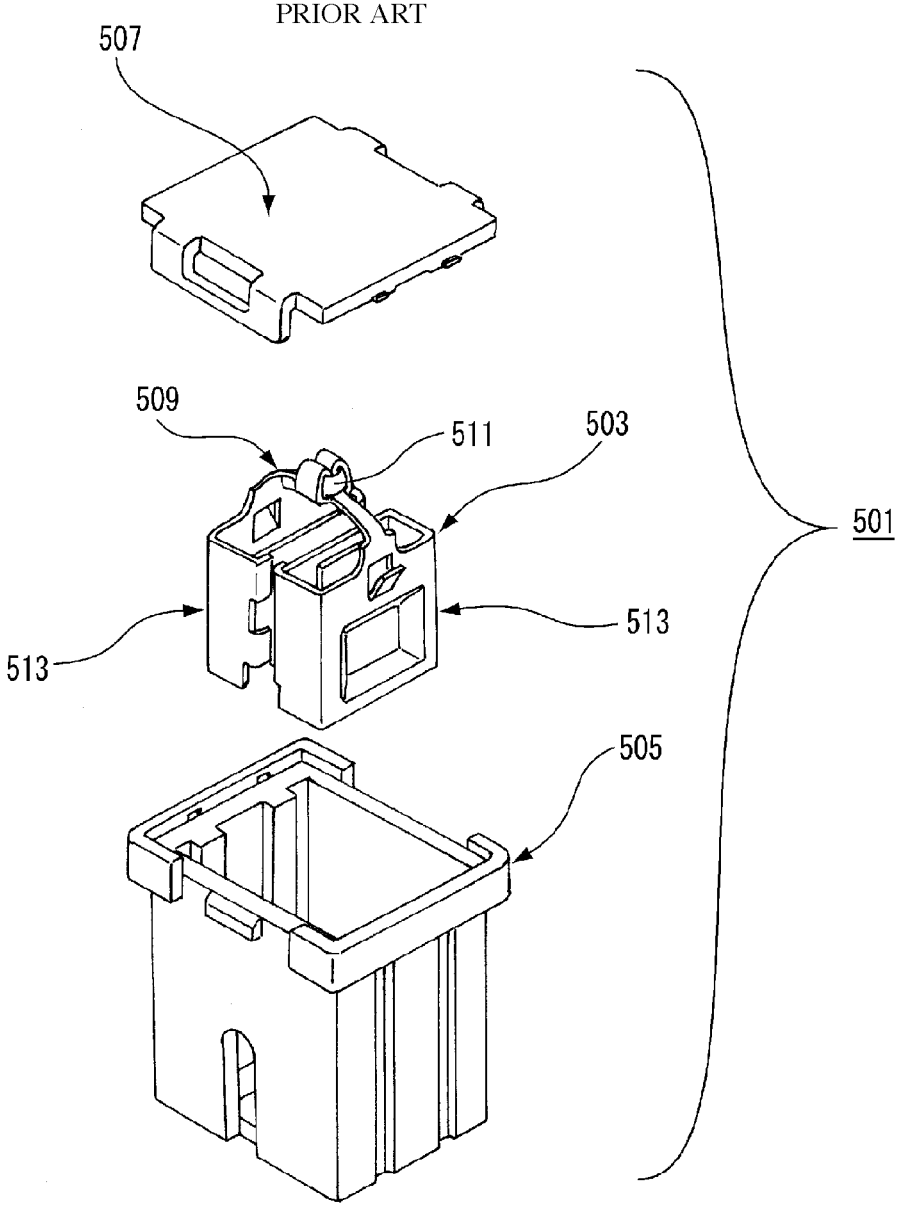
FIG.9 PRIOR ART
FIG. 9 is an exploded perspective view of a traditional cartridge fusible link.

Therefore, since the fusible link 11 of the present embodiment is provided with two components, which are the fuse element 13 and the insulative housing 15, and since the freedom in layout increases due to the flat shape, the component number may be decreased, the space of the power supply box 47 (refer to FIG. 7) can be saved, and the fusible link 11 may be commonly used in a chain fusible link 49 (refer to FIG. 8).

As shown in FIG. 7, the power supply box 47 which carries the fusible links 11 as described above, includes a blade fuse area 52 (an area enclosed by one-dot-chain lines in FIG. 7) which is divided vertically and horizontally into blade fuse cavities 519 to accommodate a number of blade fuses 517, respectively, and a fusible link area 53 (an area enclosed by dashed lines in FIG. 7) which is divided vertically and horizontally into fusible link cavities 55 of the same shape to accommodate a plurality of the fusible links 11. The fusible link cavities 55 are provided with a pair of bended mating terminals 65, respectively.

Figure 10:
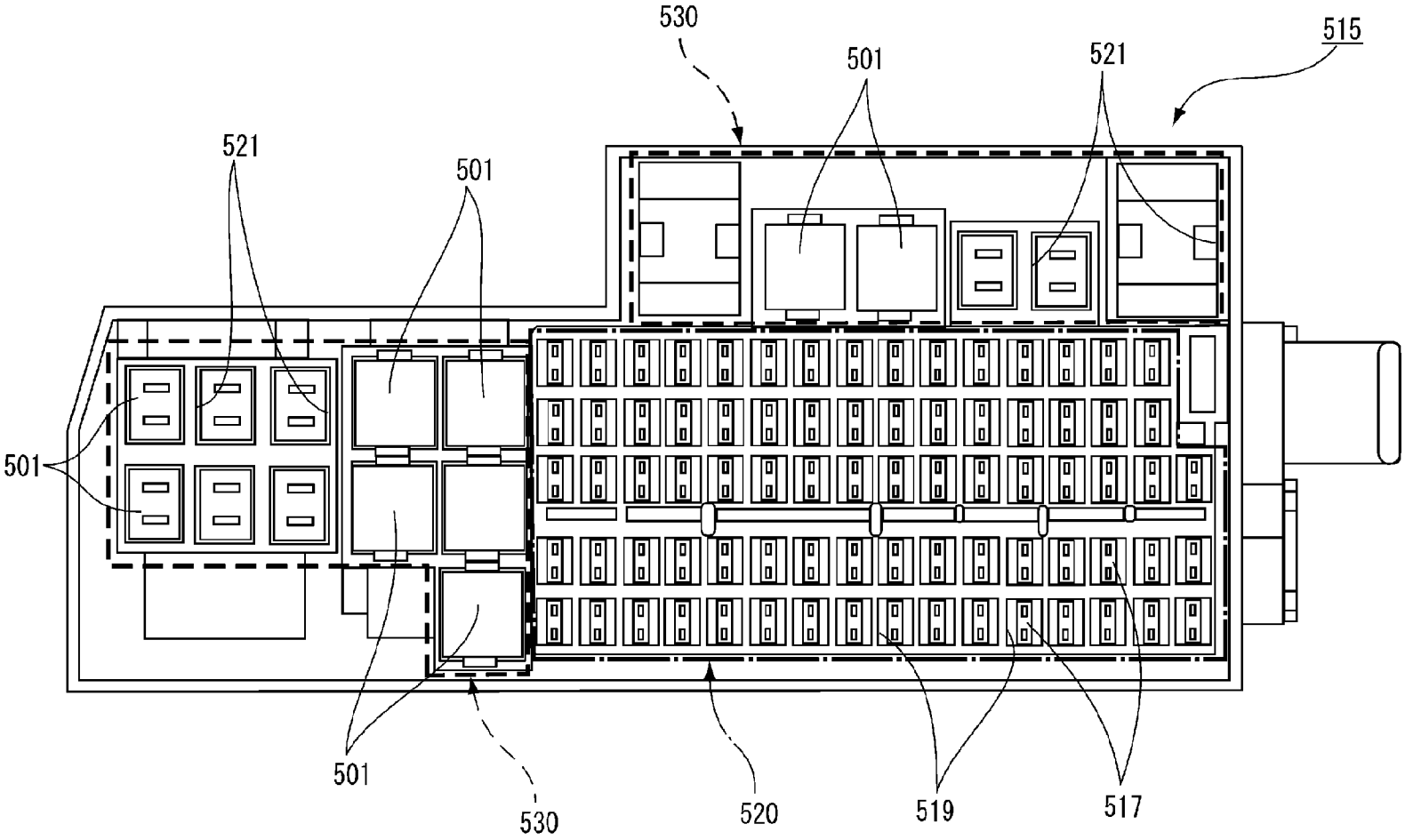
FIG. 10 PRIOR ART
FIG. 10 is a planar view of a traditional power supply box which carries blade fuses and cartridge fusible links.

The power supply box 47 according to the present embodiment includes fuse circuits, the number of which is the same as that of the traditional power supply box 515 shown in FIG. 10.

The blade fuse area 52 of the power supply box 47 shown in FIG. 7 has approximately the same size as the blade fuse area 520 of the traditional power supply box 515 shown in FIG. 10, but the fusible link area 53 to accommodate the fusible links 11 is significantly downsized compared to the fusible link area 530 of the power supply box 515 as shown in FIG. 10. To make it easy to compare the sizes, the fusible link area 530 of the power supply box 515 is illustrated by two-dots-chain lines in FIG. 7.

That is, since a plurality of flat fusible links 11, which, even if the rated current capacity differs from each other, have the same shape, are overlapped in parallel in the plate thickness direction of the fuse element 13 as shown in FIG. 7, the fusible link cavities 55 of the same size can be arranged to be aligned vertically and horizontally. Thus, when compared to the fusible link area 530, which is divided into cartridge fusible link cavities 521 with different sizes, the fusible link area 53 of the power supply box 47 according to the present embodiment can be compacted and the space of the power supply box 515 can be saved.

Then, a fusible link 11 according to a second embodiment of the present invention is described.

A chain fusible link 49 shown in FIG. 8 is formed as a chain fuse between the battery of a vehicle and the electronic components mounted in the vehicle by using the fusible link 11 described above, and the problem that the fuse circuits become complicated as the electronic components increases can be easily coped with.

The chain fusible link 49 according to the present embodiment includes a block base part 87, a connecting plate part 79, the fusible link 11 and terminal parts 95.

The block base part 87 is formed of insulative resin material, and is so set that most of the connecting plate part 79 and terminal parts 95 are embedded inside the block base part 87 by insert-molding. Fuse accommodating parts 87A to 87D, which are recessed into concave shapes, are formed in the block base part 87 to accommodate the fusible link 11. Furthermore, three recesses 91 are formed at the lower part of the block base part 87 in which LA terminals (not shown in the figure) are screw-fixed.

The connecting plate part 79 is formed of conductive material such as metal plate and is integrally embedded in the block base part 87 with two ends exposed from the block base part 87 to form bus bars. The connecting plate part 79 is provided with holes 89 at the two ends (terminals 83, 85) so that LA terminals which are attached to electric wires can be attached by being screw-fixed.

That is, the connecting plate part 79 according to the present embodiment is divided into two parts which are electrically connected with a fusible link 11*a*. The connecting plate part at one side (refer to a first connecting plate part 79A), as described previously, is integrally embedded in the block base part 87 with the tongue-shaped metal part, which becomes the terminal 83 for connecting to the LA terminal, exposed at the end. The connecting plate part at the other side (refer to a second connecting plate part 79B), is also integrally embedded in the block base part 87 with the tongue-shaped metal part, which becomes the terminal 85 for connecting to the LA terminal, exposed at the end.

For the fusible link 11 according to the present embodiment, four kinds of fusible links 11*a* to 11*d* which have appropriate fuse performances (rated current capacities) are mounted in the fuse accommodating parts 87A to 87D formed at the block base part 87 respectively so that each of the fuse accommodating parts 87A to 87D has appropriate maximum allowable currents.

The terminal parts 95 of the present embodiment include three terminals 95A, 95B and 95C exposed from the three recesses 91 formed at the lower part of the block base part 87 to connect the LA terminals, and most parts of the terminal parts 95 are integrally embedded in the block base part 87. Posts 97 are protruded from the terminals 95A, 95B and 95C to screw-fix the LA terminals (not shown in the figure) which are connected with electronic components.

The fuse accommodating parts 87A to 87D of the block base part 87 are electrically connected to the fusible links 11*a* to 11*d*, respectively. In this case, edges at one side of the first connecting plate part 79A and the second connecting plate part 79B, and the ends of the terminals 95A, 95B and 95C are exposed at the fuse accommodating parts 87A to 87D, the first planar terminal parts 17 of the fusible links 11*a* to 11*d* are connected to the edges at one side of the connecting plate part 79, and the second planar terminal parts 19 are connected to the ends of the terminals 95A, 95B and 95C. It is possible to use a variety of connecting methods such as, welding and connecting by soldering, riveting, welding by supersonic wave, welding by light laser beam or the like to connect the fusible links 11*a* to 11*d*.

According to the above-described chain fusible link 49, since the connecting plate part 79 and the terminal part 95 are connected by the fusible conductor part 25 of the fusible link 11, the chain fusible link, which integrally includes a plurality of fuse circuits between a battery terminal of a battery and output side electric circuits, can be easily constructed. That is, since the fusible link 11 according to the present embodiment is flat as a whole, a plurality of fusible links 11 can be arranged side by side in fuse circuits which are formed by the connecting plate part 79 and the terminal parts 95 in the same plane.

According to the fusible link 11 of the present embodiment, the fusible link 11 used in the power supply box 47 can be commonly used in the chain fusible link 49, and because the equipment amortization expense of the fusible link 11 is reduced, the cost may be reduced.

The constructions of the first and the second planar terminal parts, the melting part, the fuse element, the insulative housing, the welding bosses, the engaging recesses, the connecting plate and the terminal part according to the present invention are not limited to the constructions of the above embodiments, it is apparent that various embodiments may be adopted based on the purpose of the present invention.

For example, in the above-described embodiment, the cylindrical welding bosses 37 and the generally semicircular engaging recesses 41 are used to mount the insulative housing 15 to the fuse element 13, but the shapes of these welding bosses and engaging recesses are not limited, and various kinds of shapes such as oval or polygon shapes may be adopted.

The fuse of the present invention is provided with two components, which are the fuse element and the insulative housing, and since the freedom in layout increases due to the flat shape, the component number may be decreased, the space of the power supply box can be saved, and the fuse may be commonly used in a chain fuse.

What is claimed is:

1. A fuse comprising:

a fuse element which includes a first planar terminal part, a second planar terminal part, a fusible conductor part, a melting part, and a low melting point metal chip, wherein the melting part is connected to the fusible conductor part at a location that is between parallel inner side edges of the first planar terminal part and the second planar terminal part, and the fuse element further includes a front surface side that extends along each of the first planar terminal part, the second planar terminal part, and the fusible conductor part; and an insulative housing, having a melting part accommodating space to accommodate the melting part therein, which is mounted to the front surface side of the fuse element to cover the inner side edges of the first planar terminal part and the second planar terminal part and the melting part, wherein the low melting point metal chip is mounted on a portion of the front surface side that extends along the fusible conductor part, the low melting point metal chip extends from the front surface side and into the melting part accommodating space, and the front surface side where the low melting point metal chip is mounted to the fusible conductor part is located outside of the melting part accommodating space, and welding bosses, which are protruded from a mounting surface of the insulative housing located outside of the melting part accommodating space, are welded in engaging recesses which are formed at the upper and lower edges of the first planar terminal part and the second planar terminal part.

2. The fuse according to claim 1, wherein a rated current capacity of the fuse is variable by changing at least one of a conductivity of the fuse element and a width of a fusible conductor part which has the melting part.

3. The fuse according to claim 1, wherein the first planar terminal part is electrically connected by being connected to a connecting plate which is electrically connected to a battery terminal, and the second planar terminal part is electrically connected by being connected to a terminal part which is electrically connected to an output side electric circuit.

4. The fuse according to claim 2, wherein the first planar terminal part is electrically connected by being connected to a connecting plate which is electrically connected to a battery terminal, and the second planar terminal part is electrically connected by being connected to a terminal part which is electrically connected to an output side electric circuit.

5. The fuse according to claim 1, wherein the melting part includes a pair of crimping pieces that extend in a widthwise direction of the fuse element, and the crimping pieces crimp the low melting point metal chip to the fuse element.

6. The fuse according to claim 1, wherein the insulative housing includes a pair of opposed open ends, the first planar terminal part passes through one of the open ends, and the second planar terminal part passes through another one of the open ends.

7. The fuse according to claim 1, wherein the first planar terminal part extends from the melting part in a first direction, and the second planar terminal part extends away from the melting part in a second direction that is opposite to the first direction.

8. The fuse according to claim 1, wherein the fuse element includes an upper edge that connects the front surface side to the rear surface side, and the insulative housing includes a top surface cover part that extends along the upper edge of the fuse element and beyond the rear surface side of the fuse element.

* * * * *